US006092321A

United States Patent [19]

Cheng

[11] Patent Number: 6,092,321

[45] Date of Patent: Jul. 25, 2000

[54] IDENTITY TAGS

[75] Inventor: Gregory Yin-Ming Cheng, Shatin, The Hong Kong Special Administrative Region of the People's Republic of China

[73] Assignee: Victor Ka Shun Chu, The Hong Kong Special Administrative Region of the People's Republic of China

[21] Appl. No.: 09/140,068

[22] Filed: Aug. 18, 1998

[51] Int. Cl.[7] ..... G09F 3/14

[52] U.S. Cl. ..... 40/633; 40/665

[58] Field of Search ..... 40/633, 665, 5, 40/661

[56] References Cited

U.S. PATENT DOCUMENTS 2,312,204 2/1943 Weidel, Jr. ..... 40/634

2,846,796 8/1958 Polzin ..... 40/633

2,911,743 11/1959 Pokras ..... 40/633

FOREIGN PATENT DOCUMENTS 20677506 7/1981 United Kingdom ..... 40/633

*Primary Examiner*—Cassandra Davis

*Attorney, Agent, or Firm*—Jackson Walker L.L.P.

[57] ABSTRACT

An identity tag contains a label that is pierced (or otherwise marked) when the tag in fitted to a patient. This marking indicates that a proper procedure has been carried out before the label was removed from the tag for use on a patient's body sample.

4 Claims, 1 Drawing Sheet

IDENTITY TAGS

BACKGROUND OF THE INVENTION

1. Field of the Invention

The invention relates to identity tags.

2. Description of Prior Art

The invention relates more particularly although not exclusively to identity tags that are used for hospital patients. Such tags are placed conventionally on a patient's wrist or ankle for use during the patient's attendance or stay in a hospital or other treatment centre. Should the patient be required to give body fluid samples, e.g. blood, the sample also needs to be identified. Difficulties and errors can arise if precautions are not meticulously observed to match the patient and the sample at a later time.

SUMMARY OF THE INVENTION

It is an object of the invention to ensure that matching of a patient and any sample is inherently observed.

According to the invention there is provided an identity tag having a label holding part, a removable label, and a strap that fits around a limb of a patient, including means for permanently closing the strap around the limb arranged to mark the label or release the label to allow it to be removed from the holding part, in which the label holding part and the label are marked with a same unique visual identifier.

The holding part preferably comprises a pocket formed by a transparent sleeve formed on the tag out of which the label can slide from one end.

A remote end of the strap may be held to the tag by a non-releasable press stud, comprising the means for permanently closing the strap, and which stud is arranged to penetrate through the sleeve and the label to mark the label as the strap is fitted to the patient.

The unique identifier is preferably applied to both the label pocket and to the label in situ in one same operation, using laser engraving.

BRIEF DESCRIPTION OF THE DRAWINGS

An identity tag according to the invention will now be described by way of example with reference to the accompanying drawings in which.

DESCRIPTION OF THE PREFERRED EMBODIMENTS

Figure 1:
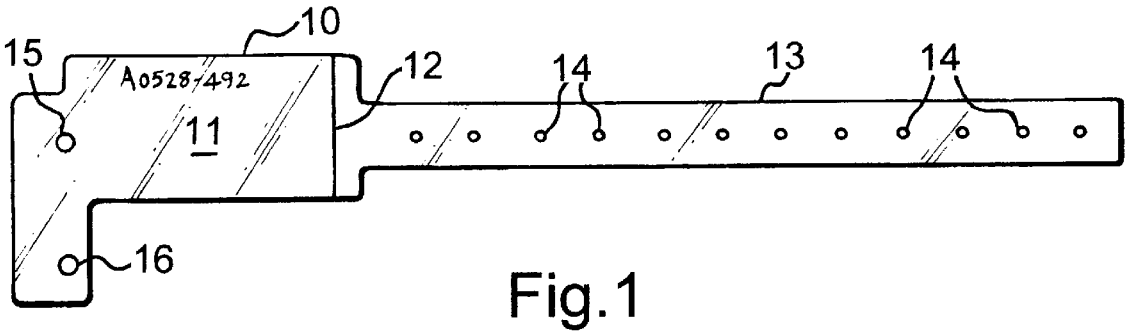
FIG. 1 is a top plan view of the tag.

Referring to the drawings, in FIG. 1 the tag is formed of transparent plastics material comprising a part 10 having two thin layers to provide a pocket 11 open at 12 An integrally formed strap 13 has a number of holes 14 that selective fit over an aperture 15 when the strap is placed around a limb of a patient. A stud 16 fits through the aperture 15 so as to secure the tag to the limb when required.

Figure 2:
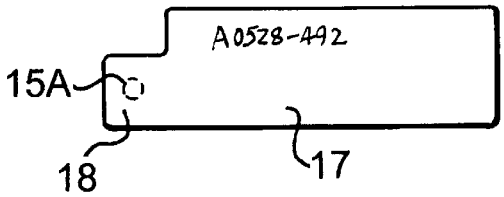
FIG. 2 is a top plan view of a label for the tag.

A label 17 in FIG. 2 is normally held in the pocket 11 and has a tongue 18, which may have a perforated aperture 15A, that is positioned over the aperture 14. The sleeve 11 in any event extends over at least the region of the aperture 14 to allow the tongue to be positioned over the aperture 14. This means that when the stud is fitted the label is penetrated by the stud 16.

Figure 3:
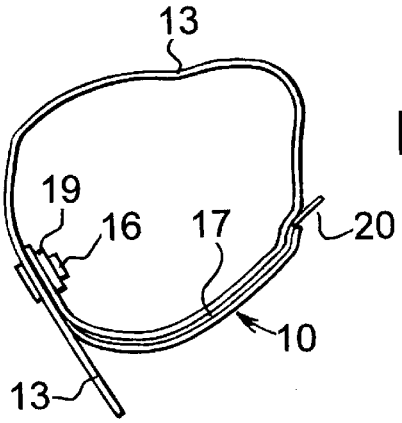
FIG. 3 is a top view of the tag in use.
Figure 4:
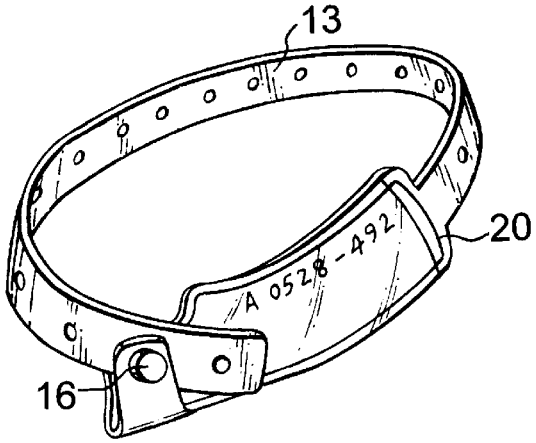
FIG. 4 is an isometric view of the tag in use.

In FIGS. 3 and 4 the tag is shown in use and the stud 16 fits permanently, once it has entered through the aperture 14, into a holding anchor 19 fixed to an undersurface of the strap 13. Thereafter the strap cannot normally be removed from a limb of a patient, and must be removed when required by cutting through the strap, for example.

It will be noted that an end 20 of the label 17 extends beyond the mouth of the pocket 11 to enable the label to be gripped and pulled out of the pocket as and when required. In normal use, the tog is fitted to a patient's limb and when a patient's sample is taken the label 17 is removed from the tag and affixed to a sample container. The label can then be matched up with the particular patient, after the sample has been tested or identified for example, by correspondence with the patients tag.

For this purpose, the label and the tag carry a unique identifier. In this case, the identifier comprises letters and numbers (A0528-492) and it is an important feature of the embodiment that the identifiers are formed in a single operation, such as by laser engraving. The identifier is printed on the label in situ, that in when it is inside the sleeve 11. At the time of printing, the identifier for the tag is formed on a corresponding part of an inside surface of the pocket. The printer is arranged to print a number of tags and labels, usually in number and/or alphabetical sequence, so as to provide a unique identifier on each tag and corresponding label.

In the described tag, the label is penetrated by the stud 16 when the tag is fitted to the patient. When the label is removed, it tears or is further damaged adjacent an edge of the tongue 18 so that it is evident that when used on the patient's sample that it has been removed from a tag in use. In other words, the damaged tongue on a label, attached to a sample say, is a clear visual indication that the sample has been taken from a patient in the hospital following a proper procedure for using a tag. A label that is not damaged, or otherwise "marked", as a result of being in a tag that has been fitted to a patient, is therefore rejected because the proper procedure has clearly not be applied.

In another embodiment of the invention, the tag and label are provided generally as shown in FIGS. 1 and 2. However, the label 17 is arranged to be fixed in the pocket (or otherwise to the tag) and is released only when the stud 16, say, has been fitted. This means that it is impossible to remove the label until the tag has been properly (and permanently) fitted to a patient. In such case a "loose" label means that it has been released from a tag that has already been properly attached to a patient.

I claim:

1. An identity tag for a limb of a patient comprising:

a label holding part;

a removable label;

a strap that fits around said limb of said patient, said strap integrally attached to said label holding part; and means for permanently closing said strap around said limb, said closing means arranged to mark said removable label by piercing said removable label such that said label after marking may be removed from said holding part, said removable label holding part and said removable label being identified by a same unique visual identifier, said holding part further comprising a label pocket formed by a transparent sleeve formed on said tag out of which said removable label can slide from one end.

2. An identity tag according to claim 1 wherein a remote end of said strap is held to said tag by a non-releasable press stud, said stud further comprising said permanently closing means, said stud arranged to penetrate through said sleeve and said removable label to mark said removable label as said strap is fitted to said patient.

3. An identity tag according to claim 1, wherein said unique identifier is applied to both said label pocket and to said label in situ.

4. An identity tag according to claim 3, wherein said identifiers are laser engraved.

* * * * *